United States Patent [19]

Kullmann et al.

[11] 4,040,609

[45] Aug. 9, 1977

[54] METAL SMELTING PLANT WITH TREATMENT STAND TO REGULATE THE ANALYSIS OF METAL SMELTS, PARTICULARLY FOR DESULPHURIZATION OF LIQUID CRUDE IRON OR LIQUID UNREFINED STEEL

[75] Inventors: Rolf Kullmann; Erhard Pfeil, both of Duisburg, Germany

[73] Assignee: DEMAG Aktiengesellschaft, Duisburg, Germany

[21] Appl. No.: 658,101

[22] Filed: Feb. 17, 1976

[30] Foreign Application Priority Data

Feb. 18, 1975 Germany ..... 2506704

[51] Int. Cl.[2] ..... C21B 13/14

[52] U.S. Cl. ..... 266/143

[58] Field of Search ..... 266/142, 143

[56] References Cited

U.S. PATENT DOCUMENTS 2,799,492 7/1967 Hobenreich et al. ..... 266/142

*Primary Examiner*—Roy Lake
*Assistant Examiner*—E. F. Desmond
*Attorney, Agent, or Firm*—Mandeville and Schweitzer

[57] ABSTRACT

Arrangements of apparatus are provided for the automatic sequential additive treatment of metal smelts in a metal smelting plant in order to control and alter the component materials of the smelts, without the need for the physical transfer from the main production line plant to other areas for processing. Moreover, the arrangement herein brings about the required results without blocking or otherwise hindering the conventional access areas of the main production line, and provides a more accurate control of processing temperatures of the smelts during treatment procedures. This is achieved by incorporating a treatment station either in or adjacent the main production line, which station includes a plurality of treatment areas as required with branch lines parallel to or perpendicular to the main production line. The branch lines may be at the same level or suspended over the main production line and carry cranes or dollies or other treating equipment vehicles into and out of cooperating engagement sequentially with smelt ladles positioned in a particular treatment area. Each treatment area includes fixed couplings for cooperation with the individual pieces of equipment, such as desulphurization additive equipment moved into and out of each treatment area, with each treatment area having a control center for the sequential operation thereof. With this arrangement, the smelt ladles do not have to be removed entirely from the main production line area and transported to other areas for treatment, thus avoiding fluctuations in the temperature of the smelts during processing.

13 Claims, 7 Drawing Figures

(VI-VI)

(VII-VII)

METAL SMELTING PLANT WITH TREATMENT STAND TO REGULATE THE ANALYSIS OF METAL SMELTS, PARTICULARLY FOR DESULPHURIZATION OF LIQUID CRUDE IRON OR LIQUID UNREFINED STEEL

BACKGROUND OF THE INVENTION

The invention covers a metal smelting plant with a treatment stand to regulate the analysis or various components comprising metal smelts, particularly for desulphurization of liquid pig iron or liquid unrefined steel, such treatment stand being equipped to add desulphurizing and/or carburizing agents, alloying agents; to inject reactive or inert gases; to evacuate gases and extract slag; and being equipped with dollies and/or cranes, their tracks being installed before the smelting furnaces in the charging hall.

Desulphurization of pig iron in a steel mill is done in lieu of desulphurization after tapping from the blast furnace or in lieu of desulphurization in a mobile receptacle (torpedo ladle truck) between blast furnace and steel mill. Desulphurization in the steel mill is intended to lower the initial sulphur contents of e.g. 0.035% to 0.045% sulphur in order to create favorable conditions for the blasting process, after which the final sulphur contents of the finished steel are so low that higher quality of steel, such as high-duty steel, steel for the manufacture of electric plate, roller bearing steel and the like may be produced. Desulphurization of crude iron after the blasting process is used to vary the percentage of several components in the iron in order to influence casting and cooling conditions as well as material properties, and also the properties of the finished material.

The applicable metallurgic refining and/or alloying methods for the smelting of metals and metal alloys determine the ultimate properties of the material being worked or the material flux in the metal smelting plant. The desired properties of the material flux, in turn, determine the planning of the metal smelting plant.

If the metal smelting plant consists of a steel mill, the material being processed goes from the pig iron supply (blast furnace or pig iron mixer) and from the junk yard (solid metal) to the charging hall in front of the smelting furnaces. The liquid metal (steel) tapped from the smelting furnaces (steel mill converters) is either transported through the charging hall into the casting hall where it is cast into upright molds, or it is transported to strand-casting facilities bordering on the smelting furnace hall.

In accordance with a familiar proposal (technical magazine "Steel and Iron" issue of Oct. 26th, 1972, pages 1088/1089) pig iron may be desulphurized in torpedo ladles outside the steel mill in a treatment stand between blast furnace and steel mill. Placing such treatment stand inside the steel mill, however, will result in shorter transport distances and consequently decreased heat loss in the liquid metal. With a treatment stand inside the steel mill, the temperatures of the liquid metal before and after desulphurization and/or dephosphorization and/or desilicification may be maintained more closely.

In a metal smelting plant where steel or copper or other non-ferrous metals are smelted, the main transportation route for liquid pig iron, solid carburizing materials, additives and and casting metal occupies an area in the charging and/or casting hall, which is not to be encumbered by additional means of transportation. If, however, the liquid crude metal or the casting metal are to be subjected to special treatment inside the smeulting plant, additional means and routes of transportation cannot be avoided. It is known to perform these specific individual treatment stages successively in several locations inside the metal smelting plant in order to avoid the difficulties mentioned.

Another lack in the present status of technology lies with the treatment stand itself. The familiar treatment stands arranged outside the metal smelting plant and the various parts of equipment distributed in various locations in the steel mill for the treatment of liquid crude metal are either usable for smaller openings of the treatment vessel only or cannot be used for tilting vessels in the shape of ladles. A particular lack in the familiar treatment equipment lies in the insufficient removal of waste gases which escape during the treatment process. Another deficiency is the mutual interference of the individual parts of the equipment.

The object of the present invention is to arrange the treatment stand within a metal smelting plant in a location where the main material line of the metal smelting plant is never disturbed nor subjected to additional burden by the delivery and removal of the liquid crude metal to be treated from the area adjacent the main processing line.

One of the tasks to be solved by the invention is to improve upon a construction of the treatment stand for introducing additives, for example, to eliminate the disadvantages mentioned, and thus to increase the capacity of the treatment stand.

The invention solves this by arranging the treatment stand in the halls or rooms bordering on the charging hall and/or smelting furnace hall, level with the mill floor or on an elevated platform and connected via at least one transportation branch line to the main processing transportation line running in the charging hall, smelting furnace hall or towards the casting stand. The main material being treated of the metal smelting plant is thus neither disturbed nor subjected to any unnecessary additional burden. Material flux for pig iron production and for desulphurization does not occupy the same means for transportation, nor do their paths cross. This guarantees smooth operation, and delays resulting in temperature losses are avoided. Generally, the treatment stand is arranged on the mill floor. This arrangement meets the requirements of preliminary treatment of the liquid crude metal before its finishing treatment in the smelting furnaces (steel mill converters). If the floor space of the metal smelting plant is insufficient, the treatment stand may favorably be arranged, e.g. in a steel mill, on a raised platform, e.g. above the mixing hall. In accordance with the invention, the main material flux line is not disturbed even if the treatment stand is arranged in the area of the casting platform of a strand casting plant or on the casting platform of the strand casting plant.

Another possibility of location in a steel mill is to arrange the treatment stand inside the casting hall for the purpose of desulphurization of pig iron, connected to the main material processing line from the smelting furnace hall to the casting hall.

In case the metal smelting plant is a steel mill, the branch transportation line may consist of a single rail, on which a cart travels back and forth between treatment stand and the respective means of transportation which carries out all transport within the main material flux or processing line.

In this sense provision is made in the steel mill for at least one rail running at right angles with the travel course of the pig iron crane in the main line, a ladle truck running on such rail which is arranged on the mill floor from the charging hall to the mixing hall and/or from the smelting furnace hall to the casting hall. This rail is the simplest and shortest branch line from the main transport route for the material being processed.

Furthermore a tilting mechanism with a gear for the ladle is arranged on the truck which is movable in the direction of movement of the main line, and a depot area is provided for a slag receptacle, and the pouring snout of the ladle faces the slag receptacle. Such ladle truck permits the removal of slag from the ladle inside or outside the treatment stand.

Of particular importance are the following pieces of equipment provided for the treatment stand:

A track for a travelling desulphurization setup is arranged above the ladle truck in the treatment stand. The mobility of the desulphurization setup works two ways: a single desulphurization setup may be moved out of the treatment stand so that other equipment, e.g. gas evacuation equipment, may be brought into position. Secondly, the mobility is of particular advantage if operation takes place in accordance with the blastlance method or the magnesium coke bell method in order to accommodate placement of this special equipment.

Each of these methods require the insertion of an object into the treatment ladle. The invention provides the space necessary for this even if space is very limited. The bell for coke and magnesium and/or the blast-lance devices can also have a mobile arrangement.

Another characteristic of the invention is that the track for the travelling desulphurization equipment runs at right angles with the course of the ladle truck.

The principle of the invention with respect to the design of a treatment stand may also be directed towards high capacity for large quantities of pig iron to be desulphurized: to this end, several rails running at right angles with the course of the crude iron crane, for one ladle truck each, are provided as well as one track for at least one travelling desulphurization plant covering several treatment stands. It is particularly favorable to operate one single travelling desulphurization plant in chronological succession to each of the ladles in the treatment stand.

The invention further refers to the design of the travelling desulphurization plant:

The carriage of the travelling desulphurization plant includes a provision for an agitator which may be raised or lowered, with its rotary transmission or drive, for a ladle lid to be raised or lowered, with adapter for an evacuation device and an adapter for a feed pipe, whereby both adapters in operating position for the desulphurization automatically form a connection with their respective stationary equipment.

After removing the desulphurization equipment to which the ladle lid to be raised or lowered is attached, further pieces of equipment characteristic of the invention may be brought into operating position: A gas evacuation hood, to be raised or lowered, is arranged above the travelling desulphurization plant; in its lowered position such hood covers the tilting ladle and the slag receptacle and it has an opening permitting the movement of a slag removal crutch, which opening, in this position, is approximately opposite the ladle pouring snout. This makes it feasible to catch and remove the waste gases escaping during slag removal even while the ladle is tilted.

A slag removal device travels on a track running perpendicular with the tilting direction of the ladle, and the slag removal crutch of such device can be moved back and forth in tilting direction of the ladle. The mobility of the slag removal device and the feeding movements permit superposed movements in order to sweep the surface of the treated liquid metal.

In further improvement the track for the slag removal device is extended in at least one direction past the treatment stand to provide a storage station. Furthermore the track for at least one slag removal device covers several treatment locations of one or several treatment stands. Consequently, one single slag removal device is sufficient for one treatment stand with several treatment locations.

DESCRIPTION OF THE DRAWINGS

The following examples describe as metal smelting plant a steel mill with a treatment stand which mainly serves for desulphurizing crude iron. The structure described may also be utilized, without any major alterations, when refining the copper, aluminum and other non-ferrous metals.

In FIG. 1 the main material flux or production line 1*a* runs from the left side into the smelting furnace hall, i.e., pig iron low in sulphur coming from the blast furnace is transported by crane 2*a* (FIG. 6) to the charging hall 2 in front of smelting furnaces 3, 4, 5 and 6 lined up in smelting furnace hall 7, and from there it is charged into the smelting furnaces. Main material flux 1*b* for solid additives, such as scraps, enters the charging hall 2 from the right side. Smelting furnace hall 7 and combustion hall 2 are already overburdened or filled with equipment by the smelting process and transport operations for the material.

Figure 1:
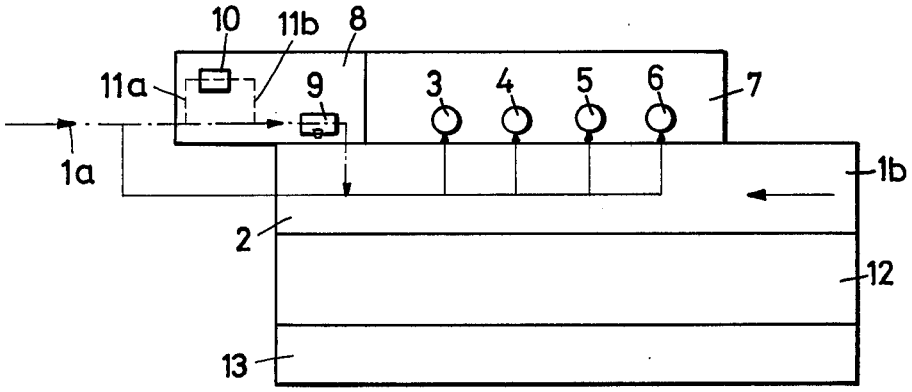
FIG. 1 through 3 are top plan views of a schematic arrangement of steel mill with different arrangements of treatment stand for desulphurization in relation to the main processing line.

In accordance with the invention, mixer hall 8 is aligned with smelting furnace hall 7. Mixer 9 stores the pig iron if prior to charging smelting furnaces 3 through 6 equalization and or control of components in the pig iron, such as sulphur, silicium, phosphorus and others, is required. Treatment stand 10 is arranged in mixer hall 8 for the desulphurization. From main material flux line 1*a* transport route 11*a* towards the treatment stand and transport route 11*b* from the treatment stand back to the main material flux are branched off. The transport routes consist of rails with carts or rails with cranes. cranes. Transport routes 11*a* and 11*b* may also consist of one rail 11, which shall be described in detail in connection with FIG. 4 through 7.

Figure 2:
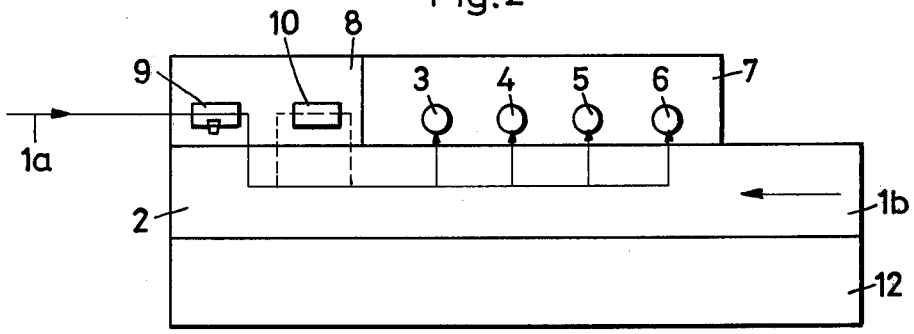

According to FIG. 2, treatment stand 10 is arranged in mixer hall 8 in the area between hall 7 and mixer 9.

Figure 3:
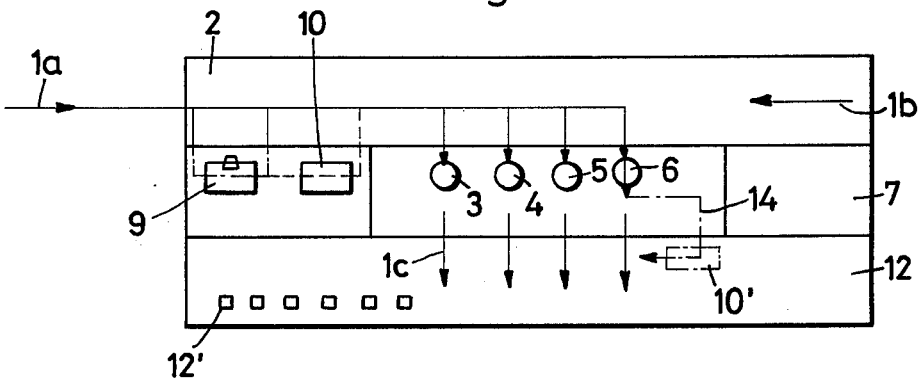

In FIG. 3, smelting furnace hall 7 is located between charging hall 2 and casting hall 12. Casting hall 12 receives main material flux 1*c* of the liquid tap metal. Instead of casting hall 12 with casting stands 12' for upright molds which, as indicated in FIG. 1, require following stripper hall 13, casting hall 12 can accommodate the casting stand of a strand casting plant. In this case, the liquid metal (e.g. crude steel) refined in smelting furnaces 3 through 6 traverses treatment stand 10' in the main line between smelting furnace hall 7 and casting hall 12. For this the transport route 14 is as shown. However, preliminary treatment (pre-desulphurization) of the liquid pig iron, as described in connection with FIG. 2, is also possible in mixer hall 8.

Figure 4:
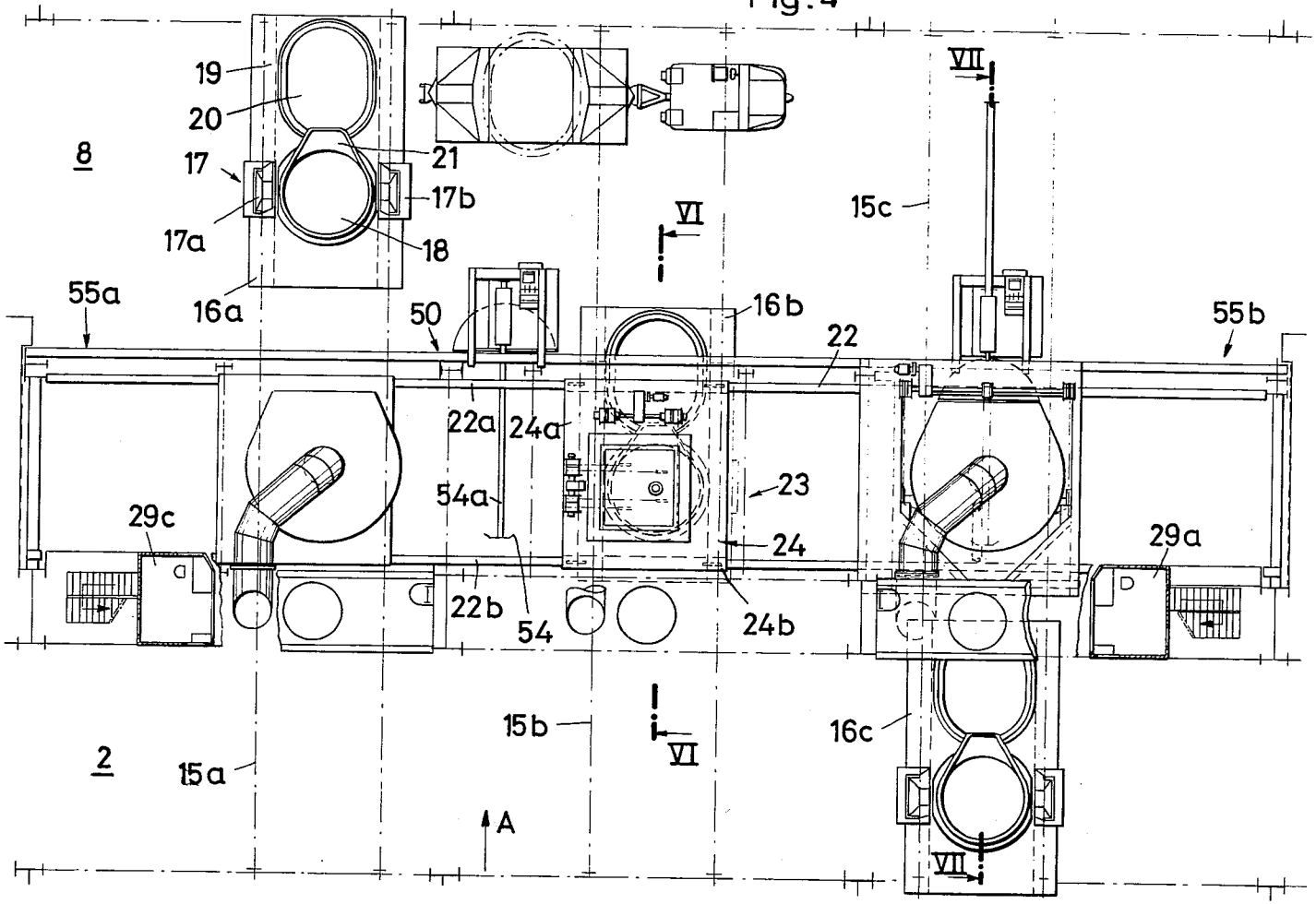
FIG. 4 is a top plan view of a treatment stand.
Figure 6:
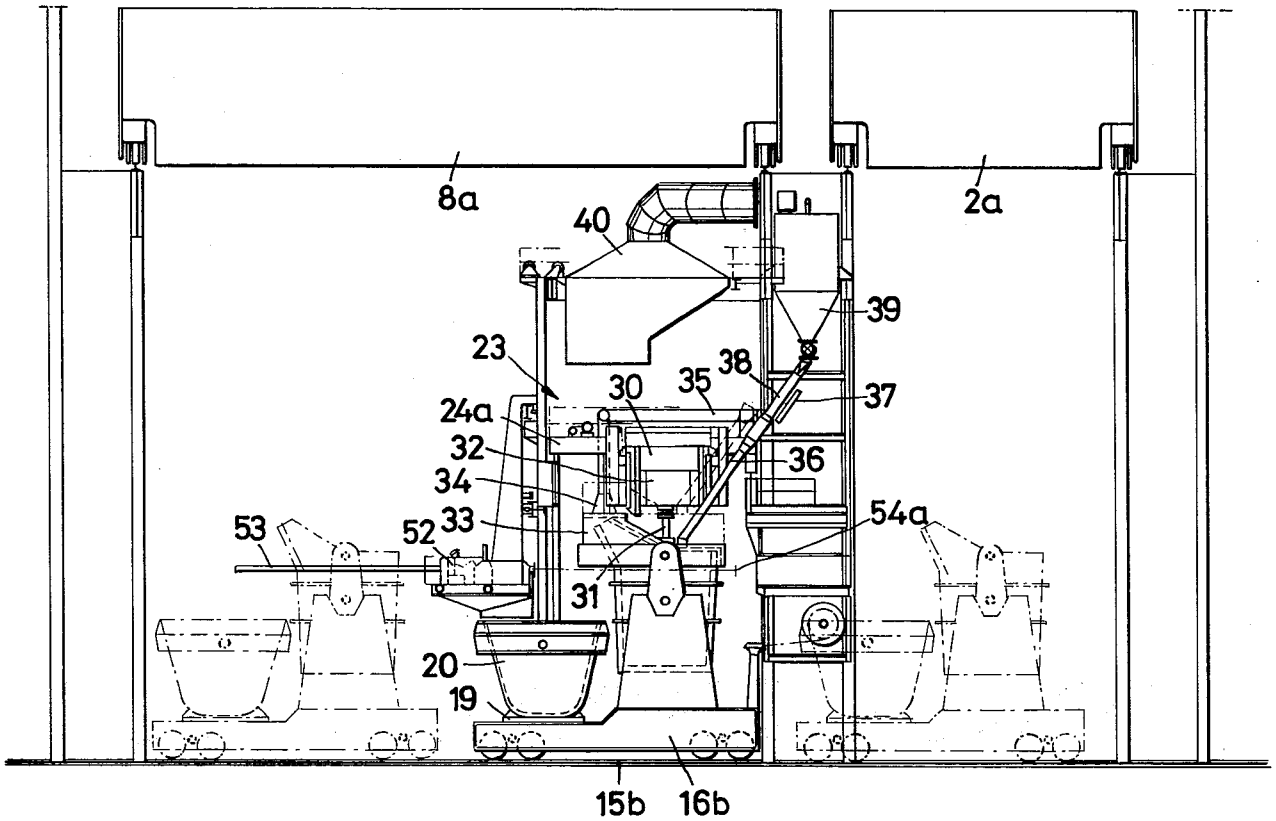
FIG. 6 is a section along lines VI—VI of FIG. 4.
Figure 7:
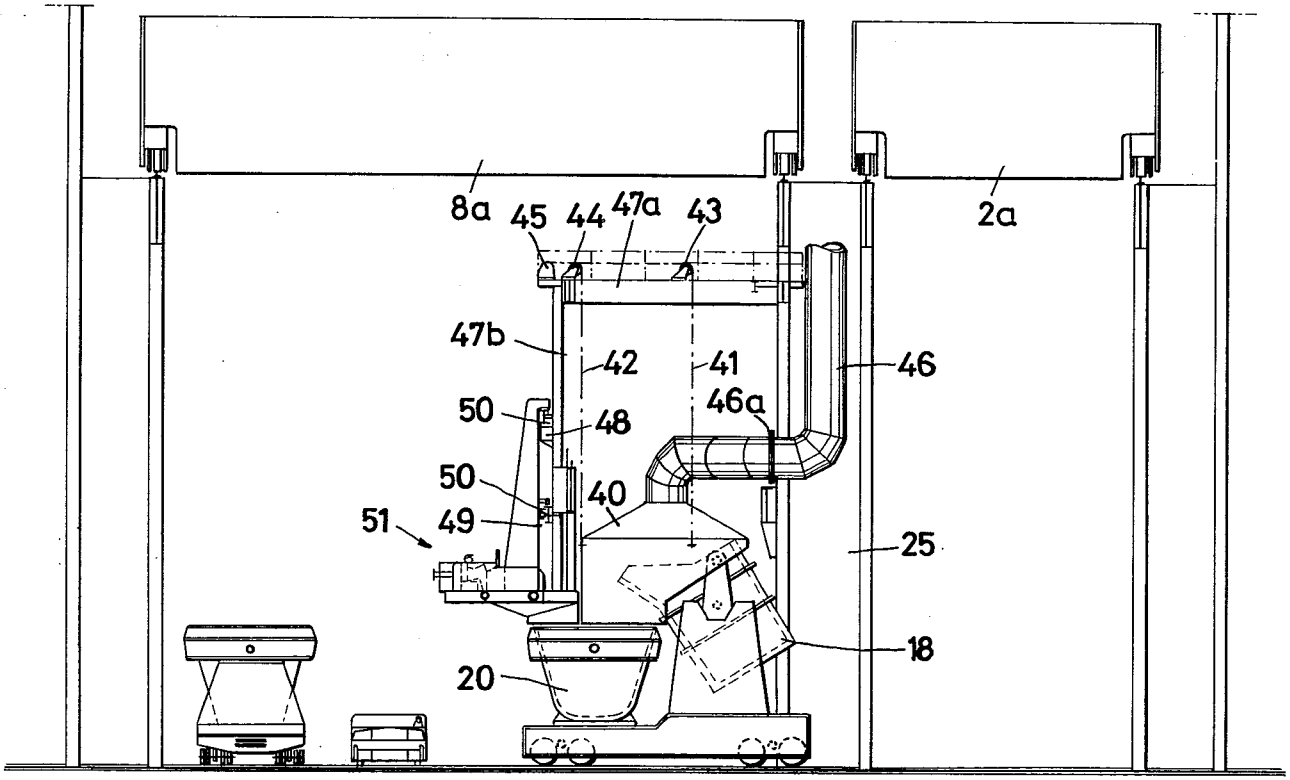
FIG. 7 is a section along lines VII—VII of FIG. 4.

Furthermore the means of transportation of a charging hall (charging hall crane 2*a*) are prerequisite in a steel mill:

FIG. 4 is based on a steel mill arranged according to FIG. 2. The charging hall or room 2 contains, as usual, pig iron crane 2*a* (FIG. 6 and 7). Mixer hall 8 is also complete with mixer hall crane 8*a* (FIG. 6). Its area of operation is penetrated by rails 15*a,* 15*b* and 15*c* which are extended to reach mixer hall 8, where treatment stand 10 is located. Ladle trucks 16*a,* 16*b* and 16*c* travel respectively on one of the rails. Each ladle truck 16 comes equipped with a tilting mechanism 17, consisting of pivot bearings 17*a* and 17*b,* to accommodate ladle 18 by way of the usual loops and/or pins. The same type of gears used for converters or ladle tilt seats may serve as tilting gear. Depot 19 is reserved for slag receptacle 20 on the ladle truck 16.

Tilting ladle 18 is suspended from tilting mechanism 17 with pouring snout 21 pointing in the direction of slag receptacle 20.

Track 22 consisting of rails 22*a* and 22*b* for the travelling desulphurization plant 23, is provided in treatment stand 10; carriage 24 of desulphurization plant 23 consists of a roughly rectangular frame 24*a* with wheels 24*b* located at the corners. Track 22 runs, according to FIG. 4, parallel with charging hall 2 and perpendicular to rails 15*a,* 15*b* and 15*c.*

Figure 5:
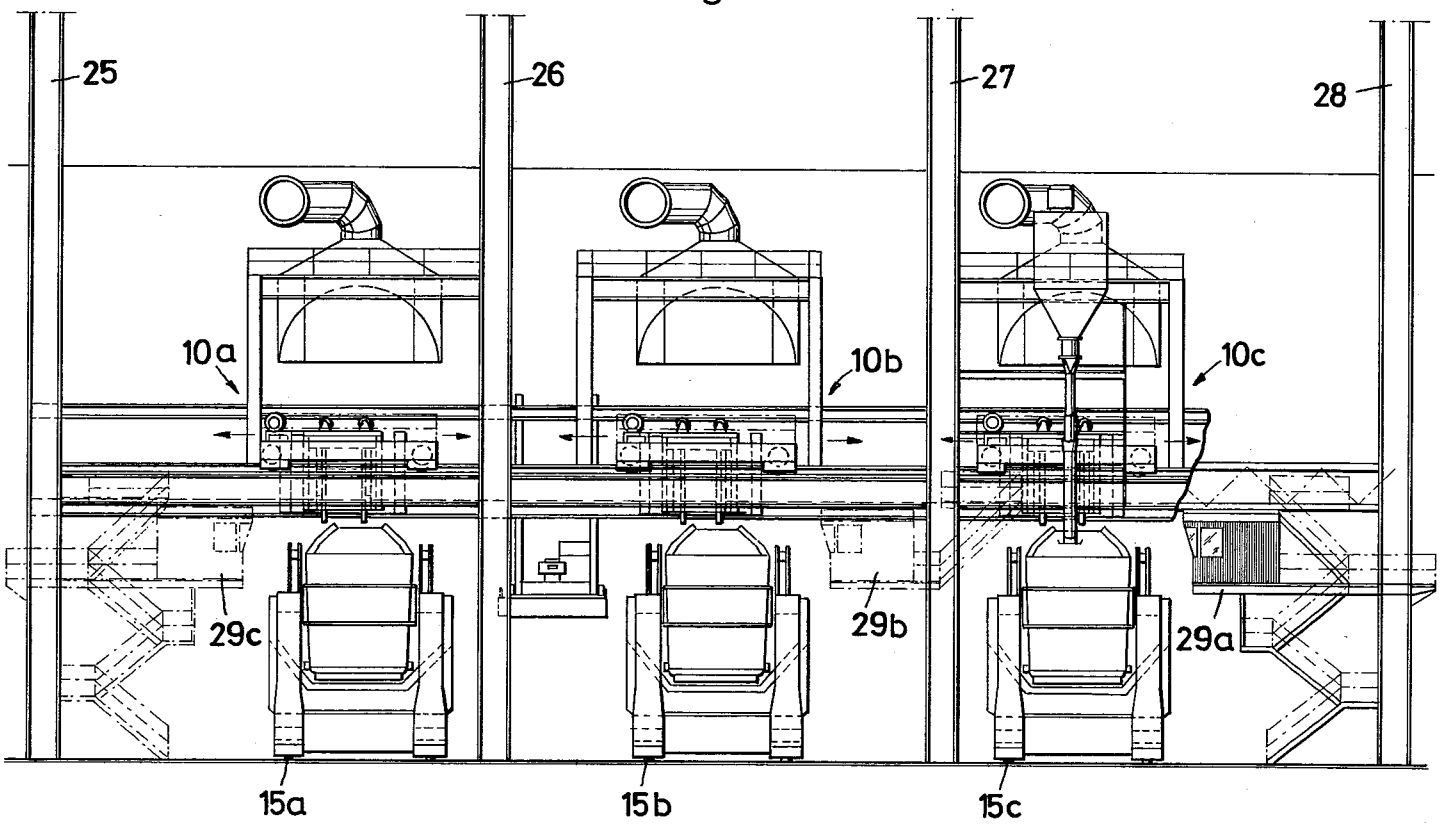
FIG. 5 is an elevational view in the direction of arrow A in FIG. 4.

In accordance with FIG. 5, treatment stand 10 with rails 15*a,* 15*b* and 15*c* is arranged between hall and/or crane track supports 25, 26, 27 and 28 of charging hall 2 and/or mixer hall 8. Each desulphurization plant 23 is equipped with a control center 29*a,* 29*b* and 29*c* for the gears of the individual apparatuses described as follows.

Carriage 24 of a travelling desulphurization plant 23 (FIG. 6) is equipped at frame 24*a* with device 30 for agitator 31 which can be raised or lowered and which comes with rotary drive 32, which is guided vertically on the outside by means of rollers and rails attached to the frame. Frame 24*a* further carries ladle lid 33, its guide formed by the same roller-rail principle being displaced from the rotary axis of the agitator. Ladle lid 33 surrounds the ladle muzzle including pouring snout 21. Adapter 34 for gas evacuation device 35 is attached to the raised part of ladle lid 33 which is located opposite pouring snout 21 in operating position. Adapter 36 for charge pipe 38 is located near the rotary axis of agitator 31. A tight connection with the stationary pipe part 38 and thus with charge bunker 39 is made via gear 37 operated from control center 29.

In accordance with FIG. 6, the area above desulphurization plant 23 contains a voluminous gas evacuation hood 40 for ladle 18 with slag receptacle 20. Gas evacuation hood 40 hangs from cables 41 and 42 (FIG. 7), connected to cable drum 45 via stationary rolls 43 and 44. On supports 25 (through 28) stationary gas evacuation pipes 46 are arranged which leads to gasket 46*a.*

In accordance with FIG. 7, rolls 43, 44 and cable drum 45 and thus also gas evacuation hood 40 are supported by a framework consisting of horizontal girder 47*a* and column 47*b.* Several columns 47 are connected at various levels by girders 48 and 49 and these serve as bearings for track 50 consisting of one rail each. Slag removal device 51 travels on wheels on the rails in the manner of a wall console crane. It consists of a multistage piston cylinder 52 (FIG. 6), piston rod 53 and slag removal crutch 54 (FIG. 4) attached to the tip of the piston. Slag removal crutch 54 has been indicated on FIG. 4 and 6 extended to the limit of its reach (54*a*). When withdrawn, slag removal device 51 remains at the stations 55*a* and/or 55*b* which are extensions of track 50 (FIG. 4).

The mode of operation of treatment stand 10 is the same at the several treatment locations 10*a,* 10*b,* 10*c,* (FIG. 5) and as follows:

In order to desulphurize pig iron, a full ladle 18 is set on ladle truck 16 by means of combustion hall crane 2*a* and moved to one treatment location 10*a,* 10*b,* 10*c* of treatment stand 10 (FIG. 6). In the position as indicated the following takes place: approach of desulphurization plant 23, lowering of agitator 31 as well as connection of adapters 34 for gas evacuation device 35 and for feed pipe 38. After the desulphurization process, the equipment parts mentioned are returned. For slag removal according to FIG. 7 gas evacuation hood 40 is lowered and slag removal crutch 54 is operated. After removing the aggregates indicated, ladle 18 may be transported to the casting stand and/or the casting hall.

We claim:

1. A metal smelting plant comprising a. a charging hall;

b. a smelting furnace hall adjacent said charging hall;

c. a casting hall adjacent said charging hall;

d. a main production line for carrying metal smelts through said smelting furnace hall, and said charging hall to said casting hall; the improvement characterized by e. an additive treatment area for said smelts adjacent said main production line;

f. at least one branch transportation means connecting said main production line and said additive treatment area; and g. said additive treatment area including floor mounted treating means and suspended treating means.

2. The plant of claim 1, further characterized by a. said plant is a steel mill;

b. said treatment area is a desulphurization treatment area for pig iron smelts;

c. a mixer hall is disposed along said main production line before said smelting furnace hall, and d. said treatment area is disposed between said mixer hall and said smelting furnace room.

3. The plant of claim 1, further characterized by a. said plant is a steel mill;

b. said treatment area is a desulphurization treatment area for pig iron; and c. said treatment area is connected to the main production line running between said main charging hall and said casting hall.

4. The plant of claim 1, further characterized by a. said branch transportation line being at least one floor mounted rail, mounted at right angles to said main production line;

b. said main production line includes a plurality of ladle trucks for transporting said smelts to be treated; and c. said ladle trucks being sequentially movable between said treatment area and said main production line for the additive treatment of the contents thereof.

5. The plant of claim 4, furthr characterized by a. ladle tilting means on each ladle truck;

b. said ladle tilting means providing tilting movement in the direction of movement of said ladle trucks;

c. a pour spout for each ladle;

d. a slag receiving means movable into and out of said treatment area;

e. power means for moving said slag receiving means into and out of said treatment area; and f. said spout facing said slag receiving means when said slag receiving means is in said treatment area.

6. The plant of claim 5, further characterized by a. a desulphurization treatment means movable into and out of said treatment area;

b. elevated track means for moving said desulphurization treatment means; and c. power means connected to said desulphurization treatment means for causing the movement thereof.

7. The plant of claim 6, further characterized by a. said track means being positioned perpendicular to said branch transportation means.

8. The plant of claim 7, further characterized by a. said treatment area including a plurality of treatment stands;

b. said branch transportation means including rail means connecting said main transportation line to each of said plurality of treatment stands; and c. said elevated track means extending over each of said treatment stands for moving said desulphurization treatment means sequentially to each said treatment stand.

9. The plant of claim 8, further characterized by a. said desulphurization treatment means including a vertically movable agitator for engagement with the contents of each ladle truck, and a rotary drive for said agitator.

10. The plant of claim 9, further characterized by a. a ladle lid on said desulphurization treatment means;

b. gas exhaust means in each said treatment stand;

c. coupling means connecting said ladle lid to said gas exhaust means in the treatment position of said desulphurization treatment means;

d. a feed pipe in each said treatment stand; and e. feed pipe coupling means on said desulphurization treatment means for engaging said feed pipe in the treatment position of said desulphurization treatment means.

11. The plant of claim 10, further characterized by a. a slag removal crutch in each said treatment stand;

b. means for moving said crutch into and out of said treatment stand;

c. a slag ladle cooperating with said crutch;

d. a vertically movable exhaust hood in each treatment stand;

e. adapter means for said hood in the lowered position thereof; and f. an opening in said hood adjacent said ladle spout in the operating position thereof, said opening receiving said crutch in the operating position thereof.

12. The plant of claim 11, further characterized by a. a slag ladle track in said treatment area, said slag ladle being movable along each said treatment stand; and b. power means for moving said slag ladle.

13. The plant of claim 12, further characterized by a. said slag ladle track including a storage station.

* * * * *